US005233832A

United States Patent [19]

Moore, III

[11] Patent Number: 5,233,832

[45] Date of Patent: Aug. 10, 1993

[54] DAMPED HEAT SHIELD

[75] Inventor: Dan T. Moore, III, Cleveland Heights, Ohio

[73] Assignee: Soundwich, Inc., Cleveland, Ohio

[21] Appl. No.: 883,279

[22] Filed: May 14, 1992

[51] Int. Cl.[5] ..... F01N 7/10

[52] U.S. Cl. ..... 60/323; 181/240

[58] Field of Search ..... 60/272, 299, 323; 181/240, 204

[56] References Cited

U.S. PATENT DOCUMENTS

| | | | |
|---|---|---|---|
| 3,133,612 | 5/1964 | Sailler . | |
| 3,237,716 | 3/1966 | Parsons . | |
| 3,863,445 | 2/1975 | Heath | 60/299 |
| 3,908,372 | 9/1975 | Fowler et al. | 60/320 |
| 3,963,087 | 6/1976 | Grosseau | 60/299 |
| 4,022,019 | 5/1977 | Garcea | 60/323 |
| 4,085,816 | 4/1978 | Amagai et al. | 180/892 |
| 4,118,543 | 10/1978 | Donohue . | |
| 4,142,605 | 3/1979 | Bosch | 181/204 |
| 4,194,484 | 3/1980 | Kirchweger | 181/204 |
| 4,432,433 | 2/1984 | Ogawa | 181/204 |
| 4,433,542 | 2/1984 | Shimura | 60/299 |
| 4,612,767 | 9/1986 | Engquist | 60/323 |
| 4,678,707 | 7/1987 | Shinozaki et al. . | |
| 4,709,781 | 12/1987 | Scherzer . | |
| 4,851,271 | 7/1989 | Moore, III et al. . | |
| 4,914,912 | 4/1990 | Akatsuka | 60/323 |

FOREIGN PATENT DOCUMENTS

| | | | |
|---|---|---|---|
| 2037135 | 9/1971 | Fed. Rep. of Germany | 60/323 |
| 24356 | 2/1979 | Japan | 60/323 |
| 244806 | 10/1969 | U.S.S.R. | 60/323 |

*Primary Examiner*—Douglas Hart

*Attorney, Agent, or Firm*—Pearne, Gordon, McCoy & Granger

[57] ABSTRACT

A damped heat shield for a vehicle exhaust manifold includes inner and outer thin steel layers. An intermediate aluminum layer is located between the two steel layers. A high temperature corrosion-resistant coating is applied to the exterior surfaces and the edges of the shield. Such coating along the edges prevents the entry of corrosion producing substances into the interior of the shield. The outer steel layer has a thickness greater than the inner steel layer, so that the two layers do not resonate at the same frequency, and therefore, tend to damp vibrational energy more efficiently and reduce radiated sound energy and noise.

14 Claims, 2 Drawing Sheets

DAMPED HEAT SHIELD

BACKGROUND OF THE INVENTION

This invention relates generally to shields, such as heat shields, and more particularly, to a novel and improved damped heat shield.

PRIOR ART

Heat shields are often used adjacent to the exhaust manifold of an internal combustion vehicle engine. Such shields are required to prevent damaging heat from reaching the adjacent components in the vehicle engine compartment. Such heat shields are typically formed of a single layer of corrosion-resistant metal, such as aluminized steel, which is die-formed to conform generally to the manifold shape while providing an air space between the manifold and the shield. Since a typical manifold heat shield is formed of a single sheet of metal, the shield does not function as an efficient sound energy-absorbing or damped structure, particularly when the engine vibrations applied to the shield approach resonant frequency of the shield.

It is also known to provide a shield for exhaust manifolds formed of two layers of corrosion-resistant aluminized sheets of equal thickness. Such heat shields tend to improve resistance to heat transmission for a given material weight and also improve the damping of the heat shield. It is also known to laminate two metallic layers on opposite sides of a non-metallic inner layer to provide damping. The U.S. Pat. Nos. 4,678,707 and 4,851,271 describe such systems. In these systems, the inner non-metallic layer is bonded to the outer metal layers.

SUMMARY OF THE INVENTION

The present invention provides a novel and improved damped heat shield. The illustrated embodiment is an exhaust manifold heat shield. However, the invention is applicable to other shielding applications where the shield must combine high temperature heat shielding with efficient vibration damping.

The illustrated embodiment provides two very thin layers of steel having different thicknesses positioned on opposite sides of a sheet of non-ferrous metal. The two steel layers are formed of uncoated material which, in its initial state, does not have good corrosion resistance. After the three layers are formed to the desired shape, at least some edges are hemmed to maintain the layers in nested substantial abutting contact.

The assembly is then coated with a high temperature corrosion-resistant coating that not only provides corrosion resistance to the exposed surface of the shield, but also forms a seal between the layers along the edges of the shield. Although the inner surfaces of the three layers remain substantially uncoated, the entry of corrosion producing substances into the interior of the shield is prevented by the high temperature coating. Consequently, significant corrosion of the interior surfaces of the shield does not occur.

Damping and vibration absorption is improved by utilizing sheets of thin steel having different thicknesses for the inner and outer layers. Because the two layers have the same shape but different thicknesses, they have mismatched resonant frequencies. When the frequency of vibration created by engine operation or from other sources is in resonance with one steel layer, it is not in resonance with the other steel layer. Therefore, the two layers move relative to each other. The friction resisting such relative movement results in an efficient damping and absorption of the vibrational energy resulting in the radiation of less sound energy and noise. Further, it is believed that the third layer of non-ferrous metal tends to increase the friction resisting the relative movement between the two metal sheets. This further increases the damping qualities of the shield.

The third layer intermediate the inner and outer steel layers also provides resistance to thermal transmission by increasing the number of interface surface barriers within the shield.

In the illustrated embodiment, the inner and outer steel layers are formed of a steel generally referred to as double-reduced black plate The outer layer is preferably about 0.008 inches thick, while the inner layer is preferably about 0.006 inches thick. The intermediate or third layer of non-ferrous metal positioned between the inner and outer steel layers is preferably aluminum foil having a thickness of about 0.001 inches. Consequently, the total metallic material thickness of the shield is about 0.015 inches. This compares with prior art similar shields having a metallic thickness in the order of 0.036 inches. Consequently, the weight of the shield, in accordance with the present invention, is substantially less than comparable prior art shields.

After the shield is die-formed, it is coated with a high temperature resistant paint-like coating.

The coating is applied to the shield by a dipping or spraying operation, and thereafter, the shield is baked to cure the coating. The cured coating is about 0.001 inches thick. By using a dip-type coating, complete coverage, including the edges, is achieved. In fact, the coating provides a peripheral seal between the three layers to prevent entry of corrosion producing substances. This completes the manufacture of the illustrated embodiment of the present invention.

These and other aspects of this invention are illustrated in the accompanying drawings and are more fully described in the following specification.

DETAILED DESCRIPTION OF THE DRAWINGS

Figure 1:
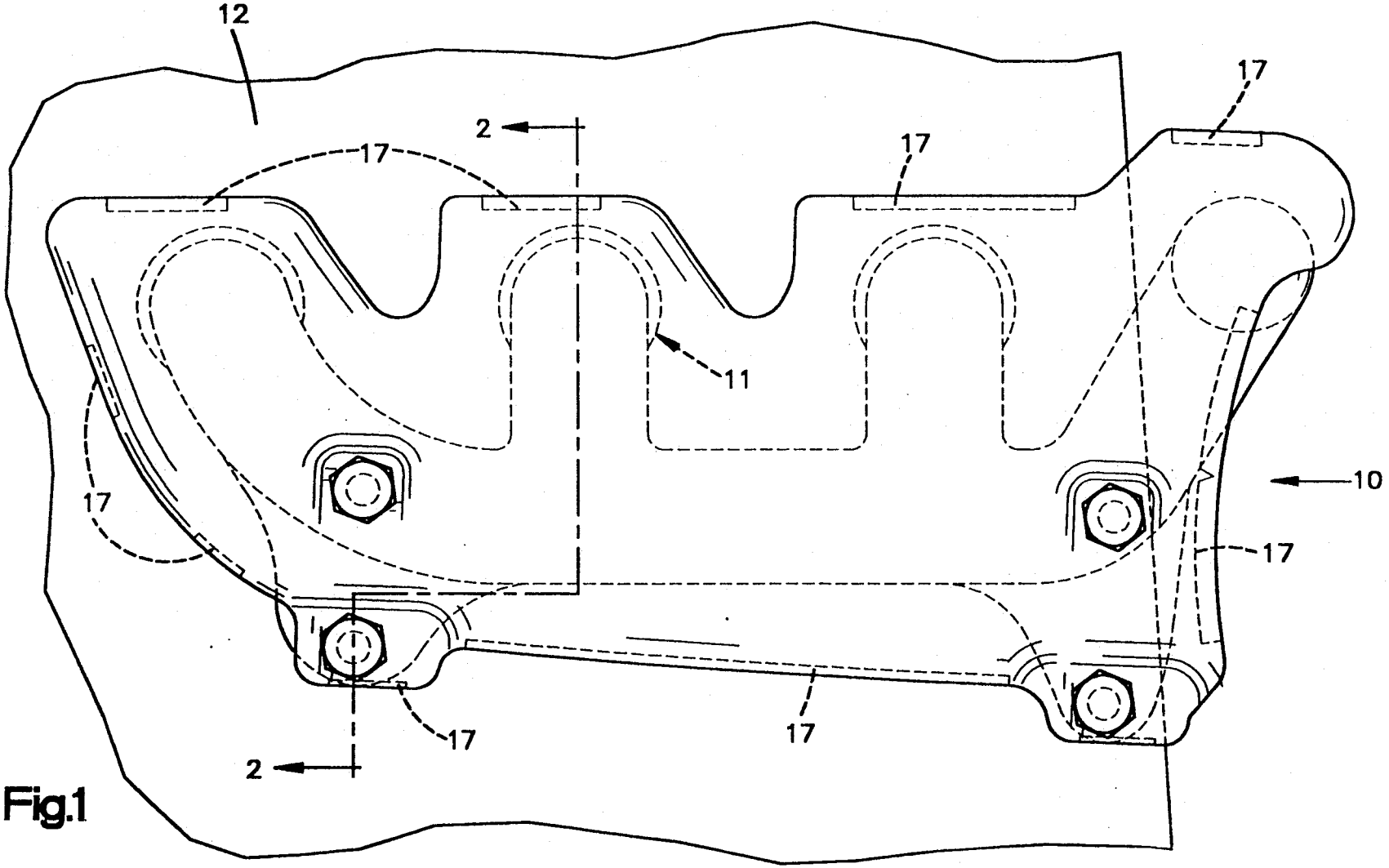
FIG. 1 is a schematic side elevation of a heat shield incorporating the present invention applied to the exhaust manifold of a vehicle internal combustion engine.
Figure 2:
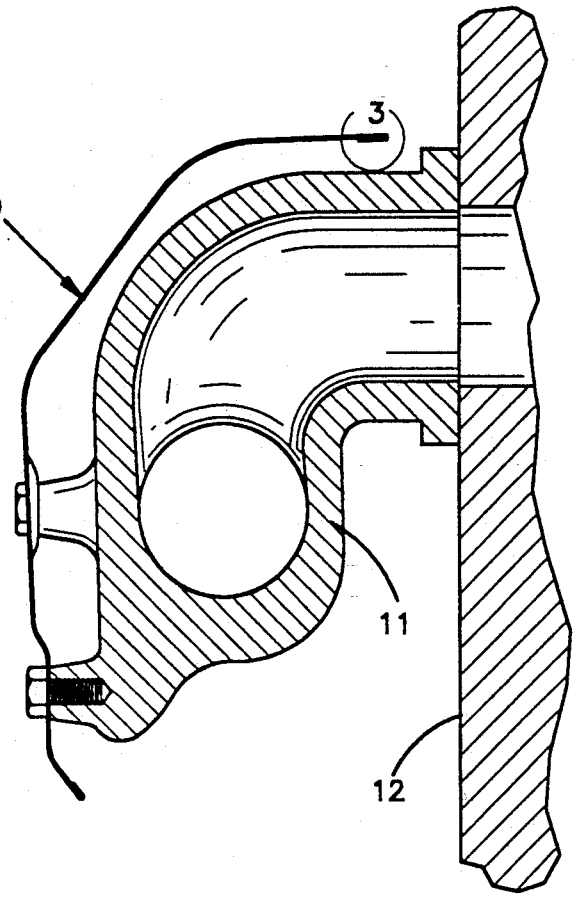
FIG. 2 is a fragmentary section taken along 2—2 of FIG. 1.

FIGS. 1 and 2 illustrate a damped heat shield 10 mounted on a schematically illustrated exhaust manifold 11 of a vehicle internal combustion engine schematically illustrated at 12. The illustrated heat shield 10 is a replacement for an existing prior art heat shield of the same configuration, but which is formed of a single layer of aluminized steel having a thickness of about 0.036 inches. Because the prior art heat shield was aluminized, it was protected against corrosion, even at the relatively high temperatures which existed in such application.

Because the exhaust manifold directly receives the exhaust gases from the engine, the exhaust manifold reaches extremely high temperatures which are a direct function of the engine loading the operating conditions. Under extreme operating conditions, the exhaust manifold 11 can reach cherry red temperatures. Normally, however, the temperatures in the manifold, per se., are at lower levels. In any event, however, the heat shield must be capable of surviving exposure to such extreme temperature conditions. In practice, however, the inner surface of the heat shield does not exceed 1000° F. to 1200° F. because it is spaced from the manifold by an air gap.

The sound reductive characteristics of the prior art single layer heat shield are very poor since the single layer is incapable of significant damping of vibrational energy. Further, the single layer heat shield tends to establish a more pronounced resonance containing more energy and creating a slower sound decay.

In order to improve thermal shielding and sound damping qualities, it has been proposed to form the heat shield from two layers of aluminized steel in which each layer has a thickness of about 0.017 inches. Such thickness is the present minimum thickness of available aluminized steel and results in a two-layer heat shield of the same shape which has a total material thickness of about 0.034 inches. Consequently, the weight of such a two-layer heat shield was virtually identical to the weight of the prior art single-layered heat shields having a single layer thickness of about 0.036 inches.

Although this two-layered shield provided some improvement in damping and resistance to heat transfer, the mere fact that the two layers were relatively thick, and therefore, relatively massive, the sound damping qualities were still relatively poor. In fact, both layers having the same shape and thickness tend to have the same resonant frequency. Therefore, the tendency for the two-layer shield to resonate still existed.

In objective terms, the two-layer system radiates 10.96 times the sound as does the three-layer system of the present invention. This data was obtained by placing each of the heat shields in a semi-anechoic chamber and vibrating the exhaust manifold to which the heat shield was attached using random vibration generated from a signal analyzer through a vibration exciter. A condenser microphone monitored the A-weighted sound pressure radiating from the heat shield. The 0.008"/0.001"/0.006" three-layer system had a dBA level of 57.2 over the frequency range of 0–800 Hz. A 0.018"/0.018" two-layer system produced 67.6 dBA over the same frequency range. After converting dB to B (bels), the calculation is inverse log 6.76 divided by inverse log 5.72 equals 10.96.

In accordance with the present invention, however, the heat shield is formed of three metallic layers. The inner and outer layers are very thin sheets of steel commonly referred to as black plate. In the illustrated embodiment, the outer metal layer 13 is about 0.008 inches thick, and the inner metal layer 14 is also black plate steel, but is provided with a thickness of about 0.006 inches. Sandwiched between the inner and outer layers 13 and 14 respectively is a very thin non-ferrous metal layer 16. In the illustrated embodiment, this interior layer is preferably an aluminum foil having a thickness of about 0.001 inches.

The three layers 13, 14 and 16 are simultaneously die-formed to the required shape. Consequently, all three layers have the same configuration and extend in substantial abutting relationship. Portions of the edge of the die-formed heat shield are provided with hems 17 to permanently and tightly join the three layers along the edges thereof. These hems 17 extend along the edges, as indicated by the dotted lines, marked 17 in FIG. 1. Because of the peripheral edge shape of the shield, it is impractical to form the hems 17 along the entire edge of the shield. However, the hems are provided along a substantial portion of the heat shield edges to ensure that the layers remain nested and the edges remain substantially closed.

Figure 3:
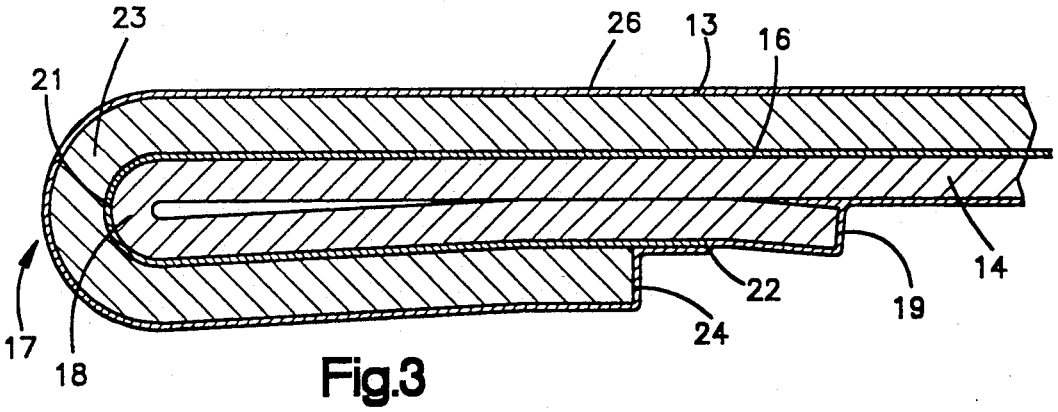
FIG. 3 is a greatly enlarged fragmentary section illustrating the structural detail at edge portions of the shield where a hem is formed.

FIG. 3 illustrates the hem structure 17 at greatly enlarged scale. The inner layer 14 is bent back upon itself at 18 and extends to a free end 19. Similarly, the interior aluminum layer 16 is formed with a reverse bend at 21 and extends to a free end at 22. Finally, the outer layer 13 is formed with a reverse bend at 23 and extends to a free end at 24. It should be noted that the free ends 19, 22 and 24 are offset a small distance from each other due to the fact that the interior layer 16 and the outer layer 13 must extend around the reverse bend of the inner layer 14. In FIG. 3, the three layers are illustrated in full and intimate contact for purposes of illustration. However, in reality, small air spaces of an irregular nature exist along at least portions of the interface of the layers due to variations of material springback after the die forming operation.

During the forming operation, the three layers are fed from three supply rolls and are maintained in aligned and abutting relationship. Preferably, the three layers are spot welded or stapled along scrap edge portions to maintain a unitary assembly. Blanks, consisting of the three layers, are cut from the supply of material. Therefore, each layer has identical size, accounting for the slight offsets noticed in the hems of FIG. 3.

Figure 4:
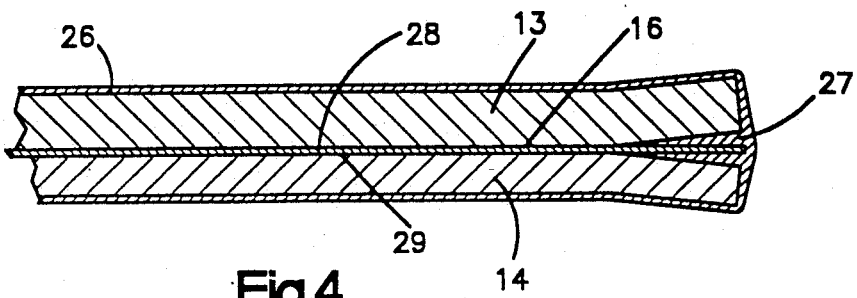
FIG. 4 is a greatly enlarged fragmentary section along an edge of the shield where a hem is not formed.

FIG. 4 illustrates an edge structure at the same scale as FIG. 3, but illustrates an edge along a zone where a hem does not exist. There is a tendency at such edge locations for a slight spreading of the edges of the three layers to exist.

After the hemming operation, the entire shield is coated along its exterior surfaces with a high temperature resistant paint-type coating. This coating 26 is applied preferably by dipping the formed and uncoated heat shield into a bath of the temperature-resistive paint coating 26. This ensures that all exterior surfaces, including the edges, are fully coated. The coating may also be applied by spraying. After removing the heat shield from the bath and allowing excess material to drip off the unit, the coated unit is allowed to dry. Then, to provide a full cure of the coating the unit is baked, for example, at about 400° F. for one hour. As best illustrated in FIG. 4, the coating material 26 penetrates into the edge zones 27 between the various layers and forms an effective seal to prevent corrosion producing substances from penetrating into the interior zone between the various layers. Similarly, a full seal is formed along the edges of the hem, as illustrated in FIG. 3. The cured coating is about 0.001 inch thick.

With this structure, the coating is only applied to the exposed surfaces of the heat shield, and the interior surfaces of the outer and inner steel layers remain uncoated. However, since the edges are fully sealed, corrosion producing materials cannot enter into the interior of the heat shield, and corrosion does not present a problem. The fact that the interior interfaces 28 between the outer layer 13 and the aluminum layer 16, as well as the interface 29 between the inner layer 14 and the aluminum interior layer 16 remain uncoated, is desirable from a damping and sound-absorption standpoint, as discussed below.

The coating 26 is preferably classified as silicone high temperature aluminum heat-resistance coatings containing a silicone copolymer. Such coatings can be obtained from a number of sources, including the following: Barrier Coatings, located at 12801 Coit Road, Cleveland, Ohio 44108, under the designation "BT1200". Another suitable coating can be obtained from the Glidden Company, at 5480 Cloverleaf Parkway, Suite 5, Valley View, Ohio 44125, under their designation product number "5542". Still another source is the Sherwin Williams Company of Cleveland, Ohio, identified by their product number "1200MSF". All of such coatings have the ability to withstand temperatures of 1000° F. to 1200° F. and operate to provide good corrosion-resistant protection to the heat shield illustrated.

The two interfaces 28 and 29 function to form a barrier resisting heat transfer through the shield. Consequently, temperatures along the external surface of the heat shield, in accordance with the present invention, are lower than in the prior art comparable single layer heat shields under similar operating conditions.

The vibration damping qualities of a heat shield, in accordance with the present invention, are far superior to the vibration damping qualities of the single-layer prior art shields for several reasons. First, by forming the inner layer 14 substantially thinner than the outer layer 13, the two layers having identical shape have different resonant frequencies. Therefore, if vibration is applied to the shield approaching the resonant frequency of one of the layers 13 or 14, the other layer will not be resonant at such frequency, and relative movement will occur along the interfaces 28 and 29. Such relative movement is resisted by the friction existing along such interfaces, and the sound and vibrational energy is quickly dissipated and absorbed. This is particularly true at higher vibration frequencies. Further, the coefficient of friction between the two steel layers and the interior aluminum layer tends to be higher than would exist between two steel layers without an intermediate layer. Therefore, the relative movement between the various components creates a frictional damping of the vibrational energy in a very efficient manner.

Finally, because the mass of the three-layered shield, in accordance with the present invention, is substantially lower than the mass of the prior art units, the three-layered system does not have the capacity to store as much vibrational energy. It should be noted that the weight of a single layer prior art comparable heat shield is about 1.16 lbs., while the same heat shield formed in accordance with the present invention is 0.54 lbs. Consequently, a heat shield, in accordance with the present invention, reduces the heat shield weight, compared to the typical prior art units, by about 50%. Further, the cost of materials and production is slightly less with the illustrated heat shield compared to the prior art single-layered heat shield. Reductions in weight, particularly in modern vehicles, is highly desirable, since improved fuel efficiency results from decreased weight. Therefore, the fact that the present invention provides weight savings, as well as improved performance, at a reduced cost, is highly valuable.

In objective terms, the prior art single-layer system 0.036 inches thick radiates 48.98 times as much sound as does the three-layer system of the present invention. This data was obtained by placing each of the exhaust shields in a semi-anechoic chamber and vibrating the exhaust manifold to which the heat shield was attached using random vibration generated from a signal analyzer through a vibration exciter. A condenser microphone monitored the A-weighted sound pressure radiating from the heat shield. The 0.008"/0.001"/0.006" three-radiating layer system had a dBA level of 57.2 over the frequency range of 0–800 Hz. The prior art 0.036 inches single-layer system produced 74.1 dBA over the same frequency range. After converting dB to B, the calculation is inverse log 7.41 divided by inverse log 5.72 equals 48.98.

In tests actually performed in production vehicles, it was found that the noise level, both in the engine compartment and in the passenger compartment of the vehicle, was substantially reduced with the heat shield in accordance with the present invention, compared to the prior art single-layered heat shield.

To summarize, a heat shield, in accordance with the present invention, improves the resistance to heat transfer, improves the damping of vibration thereby reducing the radiation of sound energy and noise, reduces weight, and reduces cost with respect to a comparable heat shield of the prior art.

Although the preferred embodiment of this invention has been shown and described, it should be understood that various modifications and rearrangements of the parts may be resorted to without departing from the scope of the invention as disclosed and claimed herein.

What is claimed is:

1. A high temperature damped heat shield for an exhaust system of an internal combustion engine, comprising two layers of sheet steel shaped to conform generally to the shape of a high temperature portion of said exhaust system while being spaced therefrom by an air gap, said layers having substantially the same shape and extending in face-to-face adjacency, one of said layers having a first predetermined thickness and having a first resonant frequency, the other of said layers having a second predetermined thickness substantially different from said first predetermined thickness and having a second resonant frequency substantially different from said first resonant frequency causing said shield to damp vibrational energy, and corrosion resistant coating means along the exterior surfaces and edges of said shield resisting corrosion of said shield at the temperatures encountered thereby, the interior surfaces of said layers being substantially free of said coating means and being free for movement relative to each other to frictionally damp vibration.

2. A shield as set forth in claim 1, wherein said corrosion resistant coating means is provided by a high temperature paint-like corrosion-resistant coating applied to the exterior surfaces of said shield and also providing a seal between adjacent edges of said layers to resist the entry of corrosion promoting substances to the zone between said layers.

3. A shield as set forth in claim 2, wherein said shield is positioned adjacent to the exhaust manifold of an internal combustion engine in a vehicle.

4. A shield as set forth in claim 1, wherein one of said layers has a thickness of about 0.008 inches and the other of said layers has a thickness of about 0.006 inches.

5. A shield as set forth in claim 4, wherein a non-ferrous metallic third layer is positioned between said two layers of sheet steel.

6. A shield as set forth in claim 5, wherein said third layer is aluminum foil having a thickness of about 0.001 inches.

7. A shield as set forth in claim 1, wherein said high temperature portion of said exhaust system reaches temperatures in excess of 1200° F., and said corrosion resistant coating means is a paint-like high temperature resistant coating capable of withstanding temperatures in excess of 1000° F.

8. A high temperature damped heat shield for a vehicle internal combustion engine exhaust system, comprising a first exterior layer of steel having a first predetermined thickness, a second exterior layer of steel having a second predetermined thickness substantially different than said first predetermined thickness, and a third interior layer of non-ferrous metal having a thickness substantially less than said first and second thicknesses, said layers being shaped to conform generally to the shape of a high temperature portion of said exhaust system while being spaced therefrom, said layers being in substantial abutting contact along adjacent surfaces thereof, and corrosion-resistance means protecting the exterior surfaces of said shield from corrosion at the temperatures encountered.

9. A shield as set forth in claim 8, wherein said third layer is aluminum foil.

10. A shield as set forth in claim 8, wherein said first predetermined thickness is at least about one and one-third times said second predetermined thickness.

11. A shield as set forth in claim 10, wherein said third layer is aluminum having a thickness of about one-sixth times said second predetermined thickness.

12. A shield as set forth in claim 10, wherein said second layer is adjacent to said high temperature portion.

13. A shield as set forth in claim 10, wherein said first predetermined thickness is about 0.008 inches, said second predetermined thickness is about 0.006 inches and said third layer is about 0.001 inches thick, and the exterior surfaces and edges of said shield are coated with a high temperature corrosion-resistant coating capable of withstanding temperatures of at least 1000° F. to 1200° F., said coating along said edges of said shield sealing said shield to prevent corrosion producing substances from reaching the interior surfaces of said shield.

14. A shield as set forth in claim 8, wherein hems are provided along at least some edges of said shield to maintain said layers nested together.

* * * * *